US012252769B2

(12) United States Patent
Dubach et al.

(10) Patent No.: US 12,252,769 B2
(45) Date of Patent: Mar. 18, 2025

(54) TIMEPIECE OR PIECE OF JEWELLERY OR GEMSTONE JEWELLERY MADE OF GOLD

(71) Applicant: Omega SA, Biel/Bienne (CH)

(72) Inventors: Alban Dubach, Bienne (CH); Gregory Kissling, Macolin (CH); Stephane Lauper, Cortaillod (CH); Denis Vincent, Neuchatel (CH); Gaetan Villard, Cossonay (CH)

(73) Assignee: Omega SA, Biel/Bienne (CH)

( * ) Notice: Subject to any disclaimer, the term of this patent is extended or adjusted under 35 U.S.C. 154(b) by 152 days.

(21) Appl. No.: 16/412,476

(22) Filed: May 15, 2019

(65) Prior Publication Data

US 2019/0368005 A1 Dec. 5, 2019

(30) Foreign Application Priority Data

Jun. 1, 2018 (EP) ..... 18175618

(51) Int. Cl.
*C22C 5/02* (2006.01)

(52) U.S. Cl.
CPC ..... *C22C 5/02* (2013.01)

(58) Field of Classification Search
CPC ..... C22C 5/02
See application file for complete search history.

(56) References Cited

U.S. PATENT DOCUMENTS

| | | | | |
|---|---|---|---|---|
| 10,136,708 | B2 * | 11/2018 | Villard | G04B 37/22 |
| 2015/0071814 | A1 * | 3/2015 | Feinberg | C22C 5/02 420/508 |
| 2015/0345001 | A1 | 12/2015 | Arnaboldi et al. | |
| 2017/0306446 | A1 | 10/2017 | Feinberg et al. | |

FOREIGN PATENT DOCUMENTS

| | | | |
|---|---|---|---|
| CN | 105308198 | A | 2/2016 |
| JP | 2016-505710 | A | 2/2016 |
| JP | 2016074937 | A * | 5/2016 |
| JP | 2016-536470 | | 11/2016 |
| WO | WO 2014/087216 | A1 | 6/2014 |
| WO | WO 2015/038636 | A1 | 3/2015 |

OTHER PUBLICATIONS

Fischer-Buhner, J. (2010). Metallurgy of Gold. In C. Corti, & R. Holliday, Gold: Science and Applications (pp. 123-159). Boca Raton, FL: CRC Press. (Year: 2010).*

"Applying, n." OED Online, Oxford University Press, Sep. 2021, www.oed.com/viewdictionaryentry/Entry/9725. Accessed Nov. 17, 2021 (Year: 2021).*

English machine translation of JP-2016074937-A of Imai (Year: 2016).*

European Search Report issued Jul. 24, 2018 in European Application 18175618.0, filed on Jun. 1, 2018 (with English Translation of Categories of Cited Documents & Written Opinion).

Ramakrishna Venugopalan, et al., "Evaluation of restorative and implant alloys galvanically coupled to titanium", Dental Materials, vol. 14, No. 3, Jun. 1, 1998, XP055494304, Amsterdam, NL. ISSN: 0109-5641, DOI: 10.1016/S0109-5641(98)00024-4, 8 pages.

Mohamed F. Ayad, "Compositional stability and marginal accuracy of complete cast crowns made with as-received and recast type III gold alloy", Journal of Prosthetic Dentistry, vol. 87, No. 2, Feb. 1, 2002, XP055494302, Amsterdam, NL. ISSN: 0022-3913, DOI:10.1067/mpr.2002.121024, 5 pages.

Korean Office Action issued on Sep. 3, 2020 in Patent Application No. 10-2019-0064741 (with English translation), 10 pages.

Combined Chinese Office Action and Search Report issued Nov. 18, 2020, in Chinese Patent Application No. 201910454278.9 (with English translation), 11 pages.

Korean Office Action issued Feb. 4, 2021 in Korean Patent Application No. 10-2019-0064741 (with English translation), 7 pages.

L*a*b*CIE 1976, Wikipedia, French version (5 pages), https://fr.wikipedia.org/wiki/L*a*b*_CIE_1976 accessed Sep. 2, 2024.

CIELAB color space, Wikipedia, English version (9 pages), https://en.wikipedia.org/wiki/CIELAB_color_space accessed Sep. 2, 2024.

* cited by examiner

*Primary Examiner* — Jophy S. Koshy
(74) *Attorney, Agent, or Firm* — Oblon, McClelland, Maier & Neustadt, L.L.P.

(57) ABSTRACT

A timepiece or piece of jewellery or gemstone jewellery made of a zinc-free, germanium-free, nickel-free, cobalt-free, indium-free gold alloy, the alloy containing, in weight percent, between 75% and 77.5% of gold, between 0.5% and 3% of palladium, between 10% and 18% of silver and between 5% and 13% of copper, wherein the respective percentages of all the alloying elements add up to 100%.

14 Claims, 1 Drawing Sheet

TIMEPIECE OR PIECE OF JEWELLERY OR GEMSTONE JEWELLERY MADE OF GOLD

CROSS-REFERENCE TO RELATED APPLICATION

This application claims priority to European Patent Application No. 18175618.0 filed on Jun. 1, 2018, the entire disclosure of which is hereby incorporated herein by reference.

FIELD OF THE INVENTION

The invention concerns a timepiece, or piece of jewellery or gemstone jewellery made of a gold alloy.

The invention also concerns a gold alloy, called 18 carat yellow gold and more particularly an alloy of this type having improved tarnishing and discolouration properties.

The invention concerns the field of the metallurgy of gold alloys for horology, jewellery and gemstone jewellery.

BACKGROUND OF THE INVENTION 18 carat yellow gold alloys according to international standard ISO 8654 represent the most widely used gold alloys in the watch market, particularly for making external timepiece parts, typically watch cases, bracelets, etc. Unfortunately, yellow gold alloys of interesting aesthetic appearance tarnish or become discoloured over time. In case of tarnishing, the colour changes from yellow to orange, blue to black. In case of discolouration, the colour changes from yellow to pale yellow. These phenomena lead to claims from clients dissatisfied with these changes. All these phenomena have been extensively studied.

As regards the tarnishing of precious metals, several studies have been launched to show the involvement of copper and silver content and the effect of phases. Adding elements such as zinc or germanium has been proposed to increase the resistance of the alloys to tarnishing. Zinc unfortunately has the drawback of polluting furnaces during casting operations. Germanium is an element that is poorly soluble in gold, creating two-phase structures if it is added in too large quantities.

As regards discolouration, the cause has also been widely studied and described as being linked to the selective dissolution of copper close to the surface causing an increase in the concentration of gold at the surface, which turns the alloy yellow. In this regard, European Patent Nos. EP2954080 and EP 2776597 are already known, which disclose 18 carat red gold alloys that resist discolouration in certain wear conditions.

There are, however, no yellow gold alloys on the market that have been developed with improved tarnishing and discolouration properties compared to the standard yellow gold alloys on the market.

SUMMARY OF THE INVENTION

It is therefore an object of the present invention to overcome the drawbacks of the aforementioned prior art by providing a timepiece, or piece of jewellery or gemstone jewellery made of an 18 carat yellow gold alloy offering improved resistance to discolouration and tarnishing compared to the yellow gold alloys of the prior art.

It is also an object of the invention to provide a timepiece or piece of jewellery or gemstone jewellery made of a zinc-free 18 carat yellow gold alloy, in order to facilitate implementation thereof.

It is also an object of the invention to provide a timepiece or piece of jewellery or gemstone jewellery made of an 18 carat yellow gold alloy having a single-phase microstructure.

To this end, the invention concerns a timepiece or piece of jewellery or gemstone jewellery made of a zinc-free, germanium-free, nickel-free, cobalt-free, indium-free gold alloy, said alloy containing, in weight percent, the following elements:

75% to 77.5% of gold;
10% to 18% of silver;
0.5% to 3% of palladium;
5% to 13% of copper, wherein the respective percentages of all the alloying elements add up to 100%.

The invention also concerns an 18 carat gold alloy that contains, in weight percent, the following elements:

75% to 77.5% of gold;
0.5% to 3% of palladium;
10% to 18% of silver;
5% to 13% of copper, wherein the respective percentages of all the alloying elements add up to 100%, and said alloy contains neither zinc, nor nickel, nor cobalt, nor germanium, nor indium.

The present invention also concerns the use of an alloy as defined above to make a timepiece, piece of jewellery or gemstone jewellery.

Timepieces or pieces of jewellery or gemstone jewellery made of an alloy as defined above are very advantageous from the point of view of their colour, their brilliance and their resistance to discolouration and to tarnishing.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
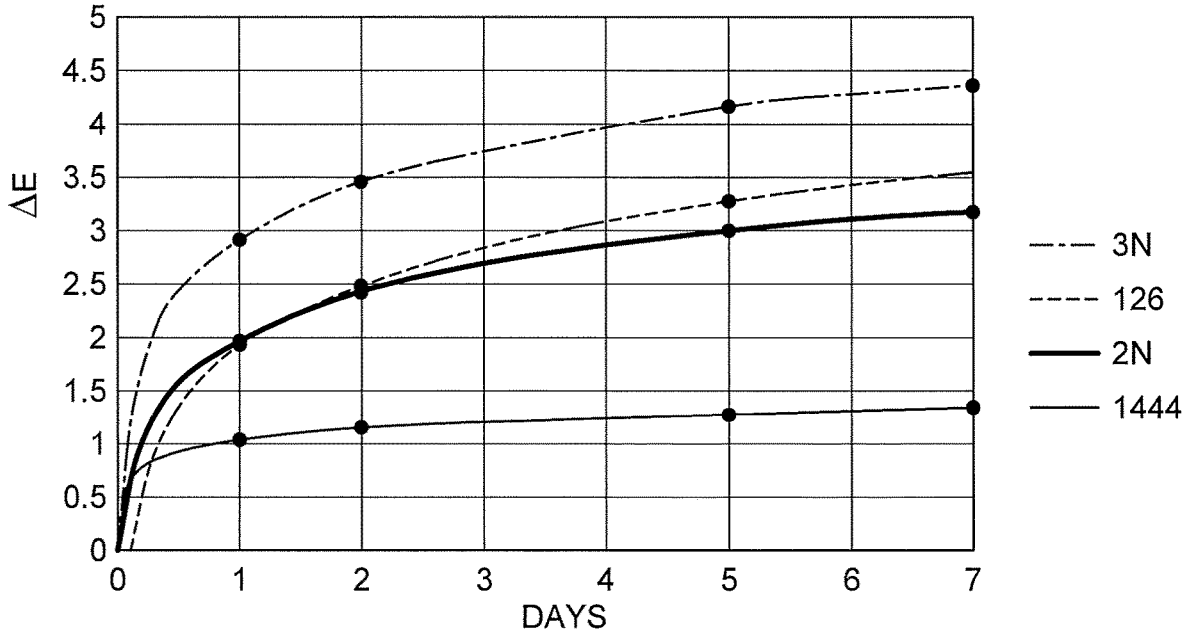
FIG. 1 shows the change in colour ΔE for the alloys No. 2N, No. 3N, No. 1444 and No. 126 as a function of time in saturated NaCl solution testing at 70° C.

The present invention concerns a gold alloy, called 18 carat red gold, comprising, in weight percent, the following elements:

75% to 77.5% of gold;
0.5% to 3% of palladium;
10% to 18% of silver;
5% to 13% of copper, wherein the respective percentages of all the alloying elements add up to 100%, and said alloy contains neither zinc, nor germanium, nor nickel, nor cobalt, nor indium.

The present invention also concerns a timepiece, or piece of jewellery or gem jewellery made of such an alloy and the use of such an alloy to make a timepiece, or piece of jewellery or gem jewellery.

Advantageously, said gold alloy contains, in weight percent, between 75% and 77.5% of gold, between 0.5% and 3%, preferably between 0.5% and 2% of palladium, between 10% and 18% of silver, between 5.5% and 13%, preferably between 6.5% and 13% of copper, wherein the respective percentages of all the alloying elements add up to 100%.

Advantageously, said gold alloy contains, in weight percent, between 75% and 77.5% of gold, between 0.5% and 3% of palladium, between 11% and 17% of silver, preferably between 11.2% and 17% of silver, between 5% and 12% of copper, wherein the respective percentages of all the alloying elements add up to 100%.

Preferably, said gold alloy contains, in weight percent, between 75% and 77.5% of gold, between 0.5% and 3% of palladium, between 11.2% and 17%, preferably between 11.5% and 17% of silver, between 6% and 13%, preferably between 6% and 12% and more preferably between 6% and 11% of copper, wherein the respective percentages of all the alloying elements add up to 100%.

According to another preferred embodiment, the gold alloy contains, in weight percent, between 75% and 77.5% of gold, between 0.5% and 3% of palladium, between 12% and 16% of silver, between 6% and 10.5%, preferably between 6% and 10% of copper, wherein the respective percentages of all the alloying elements add up to 100%.

According to another preferred embodiment, the gold alloy contains, in weight percent, between 75% and 77.5% of gold, between 1% and 2.5% of palladium, between 12.5% and 15.5% of silver, between 6% and 9% of copper, wherein the respective percentages of all the alloying elements add up to 100%.

According to another preferred embodiment, the gold alloy contains, in weight percent, between 75% and 77.5% of gold, between 1% and 2.5%, preferably between 1% and 2% of palladium, between 13% and 15%, preferably between 14% and 15%, and more preferably between 14.5% and 15% of silver, between 7.5% and 9% of copper, wherein the respective percentages of all the alloying elements add up to 100%.

Preferably, the gold alloy contains 1.5 wt. % of palladium.

Preferably, in any of the embodiments described above, the gold alloy can also contain a maximum of 0.05 wt. % of any one element or a combination of elements chosen from the group including iridium, rhenium and ruthenium. Advantageously, the alloy can contain 0.0025 wt. % of iridium.

The gold alloys of the invention find particular application in the production of timepieces, or pieces of jewellery or gemstone jewellery, such as a watch case, a dial, a bracelet, a bracelet clasp, a jewel, an accessory, etc. In this application, the alloy makes it possible to obtain timepieces, pieces of jewellery or gemstone jewellery made of 18 carat yellow gold offering better resistance to discolouration and tarnishing.

This invention will now be illustrated in more detail by means of the following non-limiting examples.

EXAMPLES

Table 1 shows the composition of the alloy No. 1444 in wt. % % according to the invention and of the alloys No. 2N, No. 3N, No. 126, which are 18 carat gold alloys, of the prior art.

TABLE 1

| N° | Au | Ag | Cu | Pd | Ir |
|---|---|---|---|---|---|
| 2N (comparative sample) | 750.6 | 160 | 89.4 | | |
| 3N (comparative sample) | 750.6 | 125 | 124.4 | | |
| 1444 (invention) | 750.6 | 145 | 89.4 | 15 | |

TABLE 1-continued

| N° | Au | Ag | Cu | Pd | Ir |
|---|---|---|---|---|---|
| 126 (comparative sample) | 773.9 | | 212.0 | 14 | 0.1 |

Table 2 sets out the composition of the test solutions and the heat conditions in which they were used. The "saturated NaCl" and "sulfur flowers" test compositions represent extreme conditions to simulate the changes that a timepiece may experience during wear, especially in Asian climatic zones.

TABLE 2

| Test | Temperature [° C.] | Formula |
|---|---|---|
| Saturated NaCl | 70 | Purified water<br>Nacl to saturation (at 70° C.) |
| Flowers-of-sulfur | 50 | 5 L closed glass desiccator, with ceramic base plate for Petri dish containing the sulfur flowers (0.1 g)<br>Atmosphere with relative humidity of 75%, maintained by means of a saturated sodium acetate solution at the bottom of the desiccator. |

The discolouration and tarnish tests were performed on washers made of gold alloys from Table 1 having a diameter of 20 mm and a thickness of 2.5 mm. The washers were successively polished with 320, 600, 1200, 2400 grit sandpaper up to felt containing diamond particles of 3 to 1 μm mean diameter.

For the saturated NaCl test, each washer was immersed in 200 ml of solution at the bottom of a closed bottle (Ø 65 mm, made of polypropylene). For the sulfur flowers test, the samples were placed inside the desiccator on the ceramic plate.

The washers were removed and rinsed to measure discolouration and tarnishing at different times during the test period and to observe the change.

The change in colour or discolouration $\Delta E_i$ after i days was calculated in accordance with the following formula:

$$\Delta E_i=\sqrt{(L_i^*-L_0^*)^2+(a_i^*-a_0^*)^2+(b_i^*-b_0^*)^2}$$

where L*, a*, b* are colorimetric values of samples measured with a Konica Minolta CM 3610 spectrophotometer (Illuminant D65, angle of observation) 2°.

The results of the discolouration test in saturated NaCl solution at 70° C. show that the alloy No. 1444 of the invention discolors significantly less quickly than the alloy No. 3N, which is a comparative yellow gold alloy, the alloy No. 2N, which is a comparative pale yellow gold alloy, and the alloy No. 126, which is a comparative 18 carat red gold alloy, of the prior art in this saline atmosphere. These results are illustrated in FIG. 1, which shows that the variation in ΔE between prior art alloy No. 3N and alloy No. 1444 according to the invention changes from 2 after 2 days to virtually 2.5 after a period of 7 days.

Figure 2:
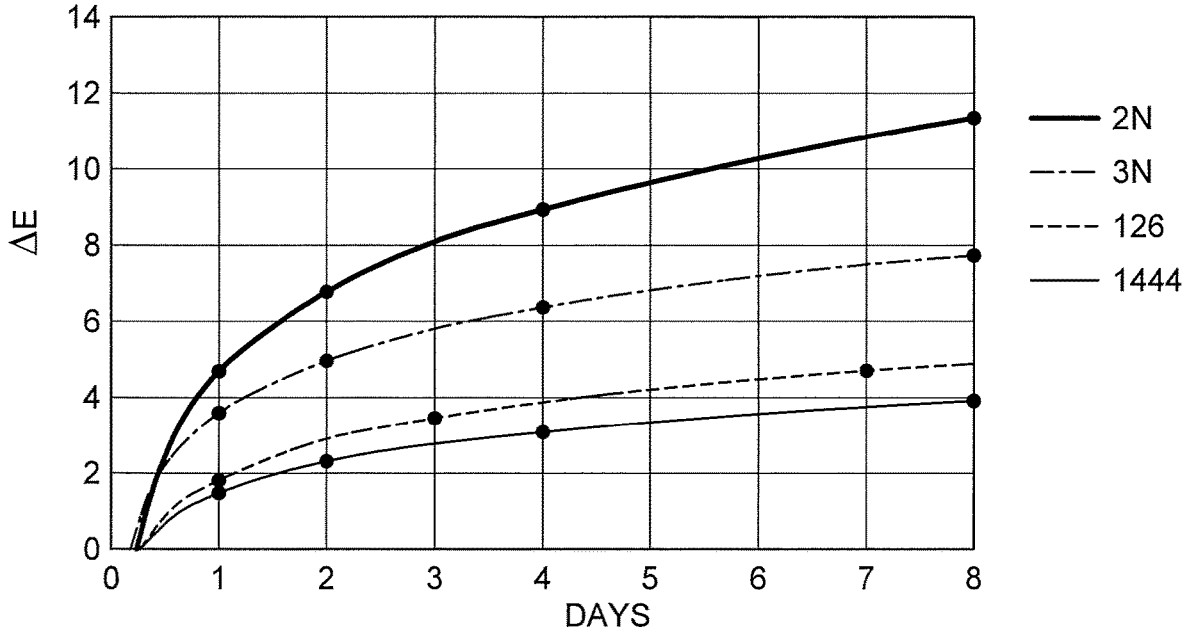
FIG. 2 shows the change in colour ΔE for the alloys No. 2N, No. 3N, No. 1444 and No. 126 as a function of time in flowers-of-sulfur testing.

The results of the tarnish test in sulfur flowers at 50° C. show that the alloy No. 1444 of the invention tarnishes significantly less quickly than the alloy No. 3N, which is a comparative yellow gold alloy, the alloy No. 2N, which is a comparative pale yellow gold alloy, and the alloy No. 126, which is a comparative 18 carat red gold, of the prior art in this sulfur atmosphere. These results are illustrated in FIG. 2, which shows that the variation in ΔE between prior art alloy No. 3N and alloy No. 1444 according to the invention changes from 3 after 2 days to virtually 4 after a period of 7 days.

These tests therefore clearly show that the resistance to discolouration and the resistance to tarnishing of the alloy according to the invention is considerably improved compared to the 18 carat gold alloys of the prior art in saline and sulfur atmospheres.

The invention claimed is:

1. An 18 carat red gold alloy, consisting of, in weight percent:

75 weight % to 77.5 weight % of gold;

0.5 weight % to 3 weight % of palladium;

10 weight % to 18 weight % of silver; and 7.5 weight % and 9 weight % of copper;

wherein the respective percentages of all the alloying elements add up to 100 weight %, and wherein the alloy is zinc-free, germanium-free, nickel-free, cobalt-free, and indium-free, wherein in a discoloration test in a saturated NaCl solution at 70° C. AE of the alloy changes from 1 at day 1 to greater than 1 and lower that 1.5 at day 7, wherein the discoloration $\Delta E_i$ after i days is calculated in accordance with the following formula:

$$\Delta E_i=\sqrt{(L_i^*-L_0^*)^2+(a_i^*-a_0^*)^2+(b_i^*-b_0^*)^2}$$

where L*, a*, b* are colorimetric values of samples measured with a spectrophotometer.

2. The gold alloy according to claim 1, wherein the alloy has a single phase structure.

3. The gold alloy according to claim 1, wherein the content of silver, in weight percent, in the alloy is from 11.2 weight % to 17 weight %.

4. The gold alloy according to claim 3, wherein the content of silver, in weight percent, in the alloy is from 11.5 weight % to 17 weight %.

5. The gold alloy according to claim 4, wherein the content of silver, in weight percent, in the alloy is from 12 weight % to 16 weight %.

6. The gold alloy according to claim 5, wherein the content of palladium, in weight percent, in the alloy is from 1 weight % to 2.5 weight % and the content of silver is from 12.5 weight % to 15.5 weight %.

7. The gold alloy according to claim 6, wherein the content of palladium, in weight percent, in the alloy is from 1 weight % to 2.5 weight % and the content of silver is from 13 weight % to 15 weight %.

8. A timepiece, piece of jewellery, or gemstone jewellery made of the gold alloy of claim 1.

9. The timepiece, piece of jewellery, or gemstone jewellery according to claim 8, wherein the content of silver in the alloy, in weight percent, is from 11.2 weight % to 17 weight %.

10. The timepiece, piece of jewellery, or gemstone jewellery according to claim 8, wherein the content of silver, in weight percent, in the alloy is from 11.5 weight % to 17 weight %.

11. The timepiece, piece of jewellery, or gemstone jewellery according to claim 8, wherein the content of silver, in weight percent, in the alloy is from 12 weight % to 16 weight %.

12. The timepiece, piece of jewellery, or gemstone jewellery according to claim 8, wherein the content of palladium, in weight percent, in the alloy is from 1 weight % to 2.5 weight % and the content of silver is from 12.5 weight % to 15.5 weight %.

13. The timepiece, piece of jewellery, or gemstone jewellery according to claim 8, wherein the content of palladium, in weight percent, in the alloy is from 1 weight % to 2.5 weight % and the content of silver is from 13 weight % to 15 weight %.

14. The timepiece, piece of jewellery, or gemstone jewellery according to claim 8, wherein the alloy is a single phase structure.

* * * * *